US008609967B2

(12) United States Patent
Simons et al.

(10) Patent No.: US 8,609,967 B2
(45) Date of Patent: Dec. 17, 2013

(54) TOP-TUNING SYSTEM FOR HAND PERCUSSION INSTRUMENT

(75) Inventors: Richard Simons, Garfield, NJ (US); Ray Enhoffer, Clifton, NJ (US); Chatchai Chandontrikit, Nakhonphathom (TH); Andrzej Krol, Wayne, NJ (US)

(73) Assignee: KMC Music, Inc., Bloomfield, CT (US)

( * ) Notice: Subject to any disclaimer, the term of this patent is extended or adjusted under 35 U.S.C. 154(b) by 0 days.

(21) Appl. No.: 12/687,765

(22) Filed: Jan. 14, 2010

(65) Prior Publication Data

US 2011/0167983 A1 Jul. 14, 2011

(51) Int. Cl.
*G10D 13/02* (2006.01)

(52) U.S. Cl.
USPC ..... 84/419; 84/413; 84/411 R

(58) Field of Classification Search
USPC ..... 84/419
See application file for complete search history.

(56) References Cited

U.S. PATENT DOCUMENTS

| | | | | |
|---|---|---|---|---|
| 3,427,917 | A | 2/1969 | Thompson | |
| D234,156 | S | 1/1975 | Lane | |
| 4,506,586 | A | 3/1985 | Brewer | |
| 4,833,964 | A * | 5/1989 | Prouty | 84/411 R |
| 4,870,883 | A * | 10/1989 | Gauger | 84/413 |
| 4,903,569 | A | 2/1990 | Kurosaki | |
| 5,280,742 | A * | 1/1994 | Vergara | 84/411 R |
| 5,417,136 | A | 5/1995 | Kralik et al. | |
| 6,018,116 | A * | 1/2000 | Simons et al. | 84/411 R |
| 6,242,680 | B1 | 6/2001 | Benton, Jr. | |
| 6,278,045 | B1 | 8/2001 | Reyes | |
| 6,372,972 | B1 * | 4/2002 | Meinl | 84/411 R |
| 6,570,074 | B1 | 5/2003 | Rode | |
| 6,949,702 | B2 * | 9/2005 | Ortega et al. | 84/413 |
| 6,953,883 | B1 * | 10/2005 | Jacobson | 84/411 R |
| D541,330 | S | 4/2007 | Lombardi | |
| 7,402,740 | B2 | 7/2008 | Van der Meulen | |
| 7,446,250 | B1 | 11/2008 | Van der Meulen | |
| 7,511,211 | B2 | 3/2009 | Kennedy | |
| 2006/0060061 | A1 | 3/2006 | Henry | |
| 2008/0141845 | A1 * | 6/2008 | Kennedy | 84/413 |
| 2009/0064844 | A1 * | 3/2009 | O'Connor | 84/411 R |
| 2009/0293703 | A1 | 12/2009 | Van Der Meulen | |

FOREIGN PATENT DOCUMENTS

| | | | | |
|---|---|---|---|---|
| AT | 33 486 A | 11/1988 | | |
| JP | 7 287568 A | 10/1995 | | |
| JP | 07287568 A * | 10/1995 | | G10D 13/00 |

* cited by examiner

*Primary Examiner* — Christopher Uhlir
(74) *Attorney, Agent, or Firm* — Colvin Hudell LLP

(57) ABSTRACT

Disclosed is a tuning system for tuning a hand percussion instrument having a head and a shell. The tuning system comprises a rim, the rim secured to the head of the instrument, the rim comprising at least one receptacle, the receptacle positioned at outer periphery of the rim such that the receptacle body is below the plane of the rim, a side plate assembly, the side plate assembly secured to the shell of the instrument, a tuning rod, the tuning rod having a first end secured to the receptacle for varying the tension on the head, and the tuning rod having a second end secured to the side plate assembly.

10 Claims, 4 Drawing Sheets

TOP-TUNING SYSTEM FOR HAND PERCUSSION INSTRUMENT

BACKGROUND

The conga is a tall, narrow, single-headed musical drum. Although ultimately derived from African drums made from hollowed logs, the Cuban conga is staved, like a barrel. Most modern congas have a staved wooden or fiberglass shell, and a screw-tensioned drumhead. They are usually played in sets of two to four with the fingers and palms of the hand.

The tuning system on a conga drum generally requires a musician to tune the drum from the side of the drum. FIG. 1 illustrates an exemplary prior art tuning system for a conga drum 10. The conga drum 10 includes a drum shell 12, an open playing end 14, and a skin 16 that is affixed to a ring 20. The ring 20 is secured to the drum shell 12 by a collection of prior art tuning assemblies 40, such that the skin is drawn across the open playing end 14. A collection of side plates 18 are distributed about the periphery of the drum shell 12.

Each of the prior art tuning assemblies 40 includes a threaded tuning hook 42. The upper portion of threaded tuning hook is inserted through holes in the ring 20, and the threaded lower portion is passed through an opening in the side plate 18. A nut 44 is threaded onto the threaded lower portion of the threaded tuning hook 42. The nut is generally tightened using a tool such as a box end wrench. As nuts 44 are tightened, the threaded tuning hooks 42, and in turn the ring 20, are drawn downward causing the skin 16 to be tunably stretched across the open playing end 14. The arrangement of the threaded tuning hooks 42 and the nuts 44 typically require the musician to tune the drum from its side. In many cases, the space needed to tune the drum may require a percussionist to remove the conga drum from its stand which may be time consuming or inconvenient, especially during a performance. The musician may also have to rotate the drum in order to reach all the tuning points.

SUMMARY

The present invention relates to a tuning system for a hand percussion instrument. In first aspect of a tuning system for tuning a hand percussion instrument having a head and a shell, the tuning system comprises a rim, the rim secured to the head of the instrument, the rim comprising at least one receptacle, the receptacle secured at outer periphery of the rim such that the receptacle body is below the plane of the rim, a side plate assembly, the side plate assembly secured to the shell of the instrument, a tuning rod, the tuning rod having a first end received by the receptacle for varying the tension on the head, and the tuning rod having a second end received by the side plate assembly.

Implementations any, all, or none of the following features. The side plate assembly can comprise a base plate, the base plate having a receiving portion that extends perpendicular to the shell, and a nut, the nut receiving the second end of the tuning rod to secure the tuning rod to the receiving portion. The tuning nut may be movable within the receiving portion so that the tuning rod may align vertically while secured to the receptacle and the receiving portion. The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
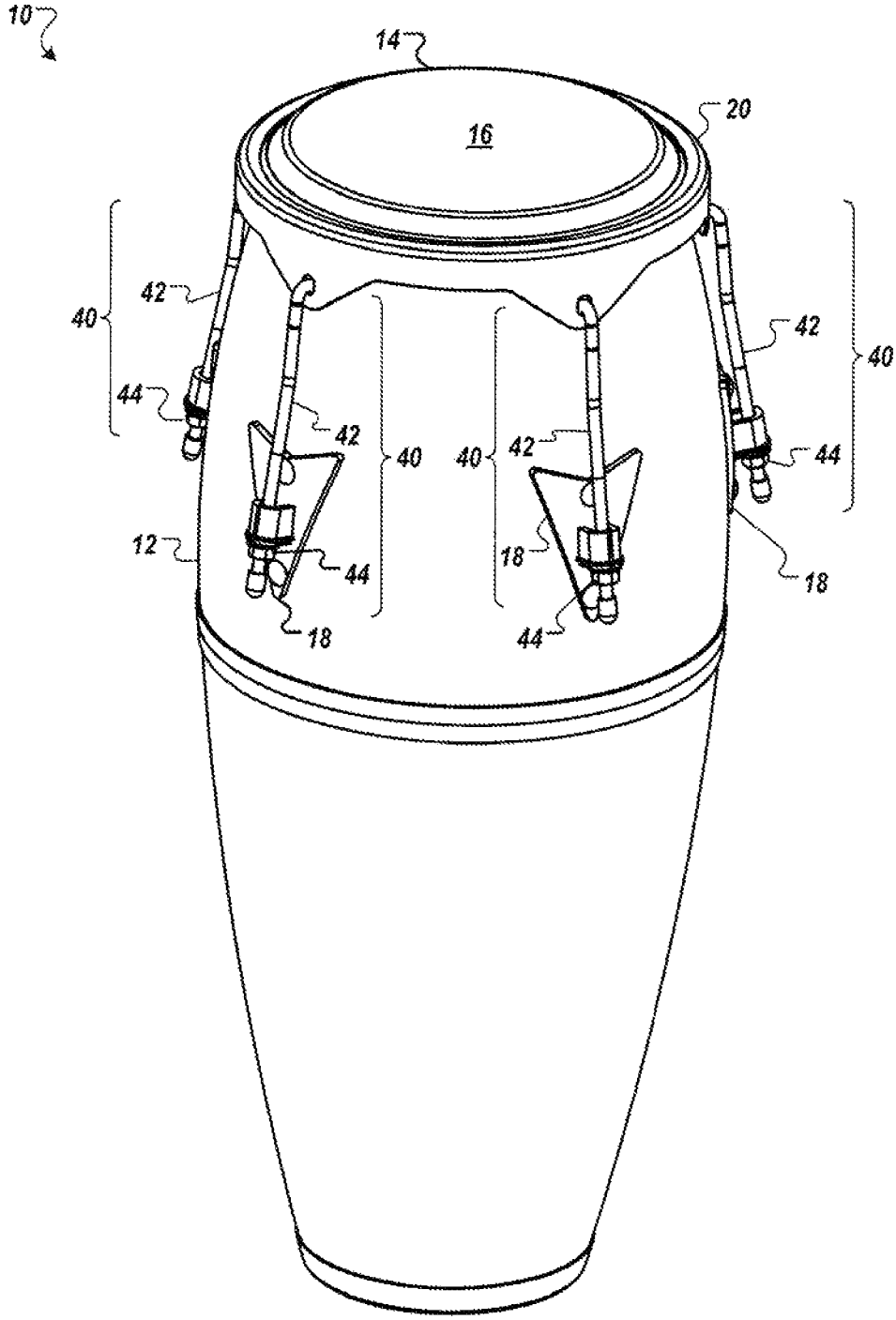
FIG. 1 (Prior Art)
FIG. 1 illustrates a prior art hand drum tuning assembly.
Figure 2:
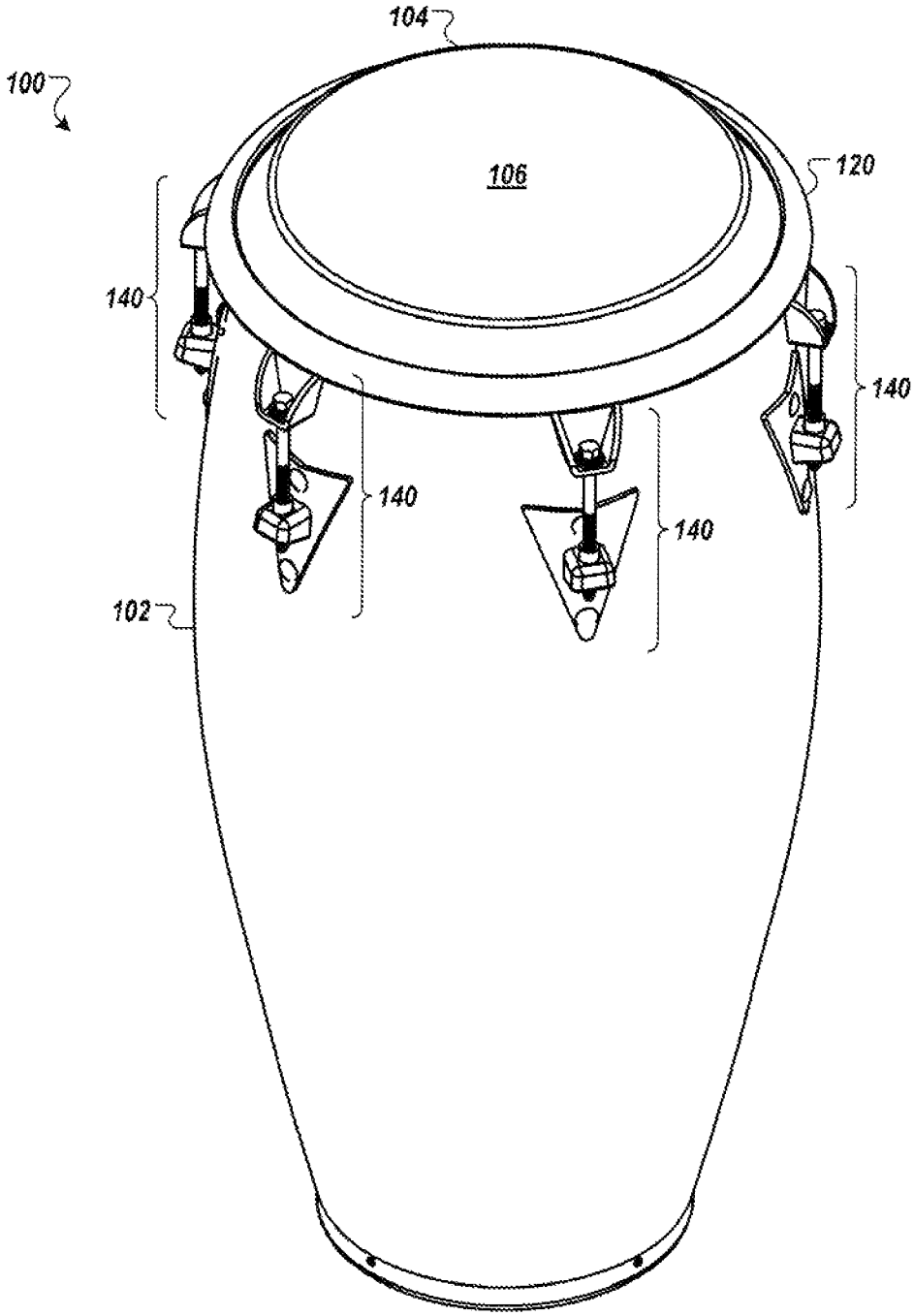
FIG. 2 illustrates an example top-tuning hand drum.

FIG. 2 illustrates an example top-tuning hand drum 100 of the present invention. In some embodiments, the hand drum 100 can be a conga drum, a djembe, a straight walled drum, a bongo drum, or other drum that is generally played by tapping or striking the instrument directly with the hands. The hand drum 100 includes a shell 102 that is generally cylindrical and hollow, with an open playing end 104 that is located at what is generally considered to be the top of the hand drum 100. The open playing end 104 is covered by a skin 106 that is affixed to a rim 120. The skin 106 is tunably stretched and held in place over the open playing end 104 by a collection of tuning assemblies 140. In general, the tuning assemblies 140 provide a percussionist with a mechanism for tuning the hand drum 100 from the top rather than from the sides of the shell 102. As such, the musician may tune the drum without having to turn the drum, lift it out of its basket, or remove it from its stand.

Figure 3:
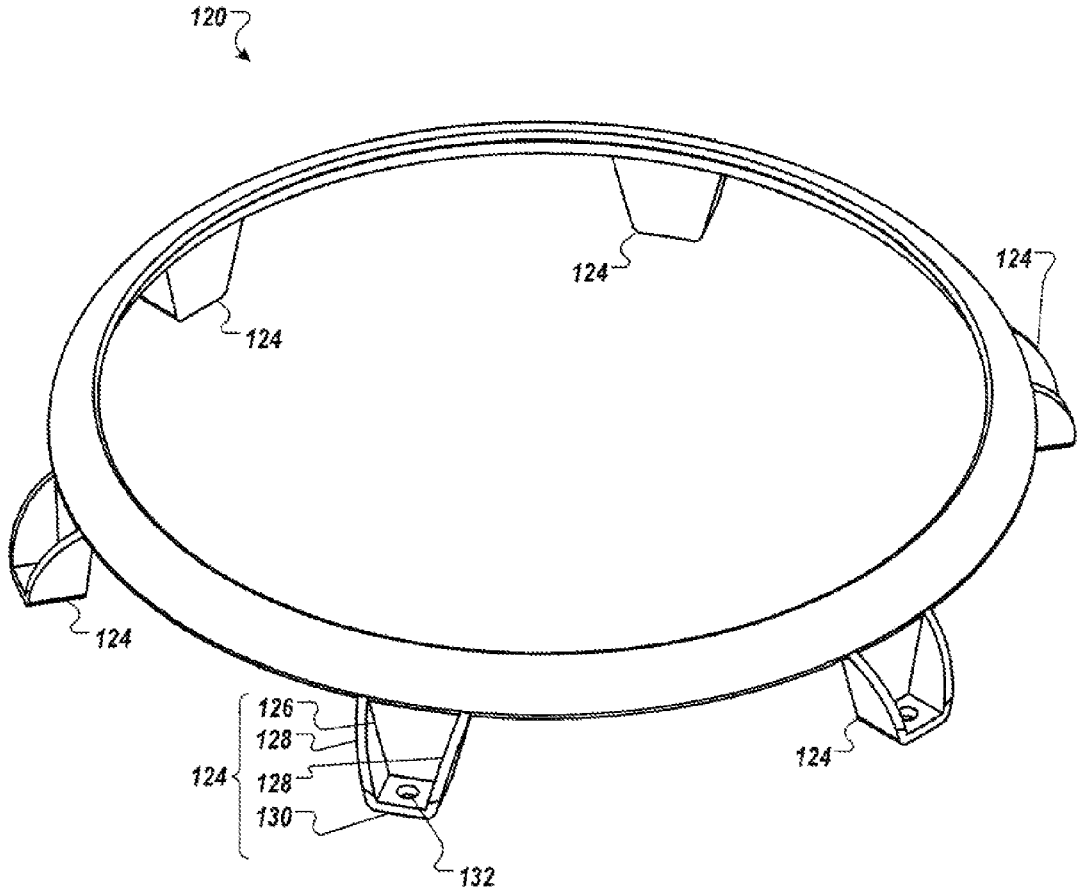
FIG. 3 is a perspective view of an example top-tuning hand drum rim.

FIG. 3 is a perspective view of the example rim 120. The preferred embodiment described below incorporates a modified Comfort Curve II steel rim available from the Latin Percussion Division of KMC Music, Inc., located in Garfield, N.J. The features of the Comfort Curve II rim are described U.S. Pat. No. 5,417,136, which is incorporated by reference. The modified rim 120 includes a circular ring section 122 and a collection of receptacle assemblies 124 distributed about the outer periphery of the ring section 122. The receptacle assemblies 124 are affixed to the ring section 122 by welding or another suitable process such that the receptacle assemblies 124 are located below the plane of the ring section 122. In other words, the receptacle assemblies 124 are located away from the open playing end 104 of the hand drum 100 as illustrated in FIG. 2. As such, the receptacles do not interfere with the hand position of the musician. This provides the musician with greater comfort and extended playability.

Each of the receptacle assemblies 124 includes a backing section 126, two side sections 128, and a bottom section 130. The backing section 126 joins the ring section 122 along an upper edge of the backing section 126. The left and right edges of the backing section 126 are joined to back edges of the two side sections 128 at substantially right angles, such that the side sections 128 are substantially parallel to each other radiate outward from the center of the rim 120. The bottom edges of the side sections 128 and the backing section 126 are joined to three edges of the bottom section 130 such that the bottom section 130 is held in a plane that is substantially parallel to the plane of the ring section 122. Formed in the bottom section 130 is a hole 132, through with the shaft of a tuning rod may be passed, as will be discussed further in the description of FIG. 4.

In some embodiments, the radially outward edges of the two side sections 128 may formed as a partial arc that substantially extends the slope of the ring section 122. In some embodiments, the two side sections 128 may provide protection for the percussionist. For example, by forming the outward edges of the side sections 128 in a smooth curve, the percussionist may be protected from hitting his or her had directly on the bottom section 130 and causing possible discomfort or injury.

Figure 4:
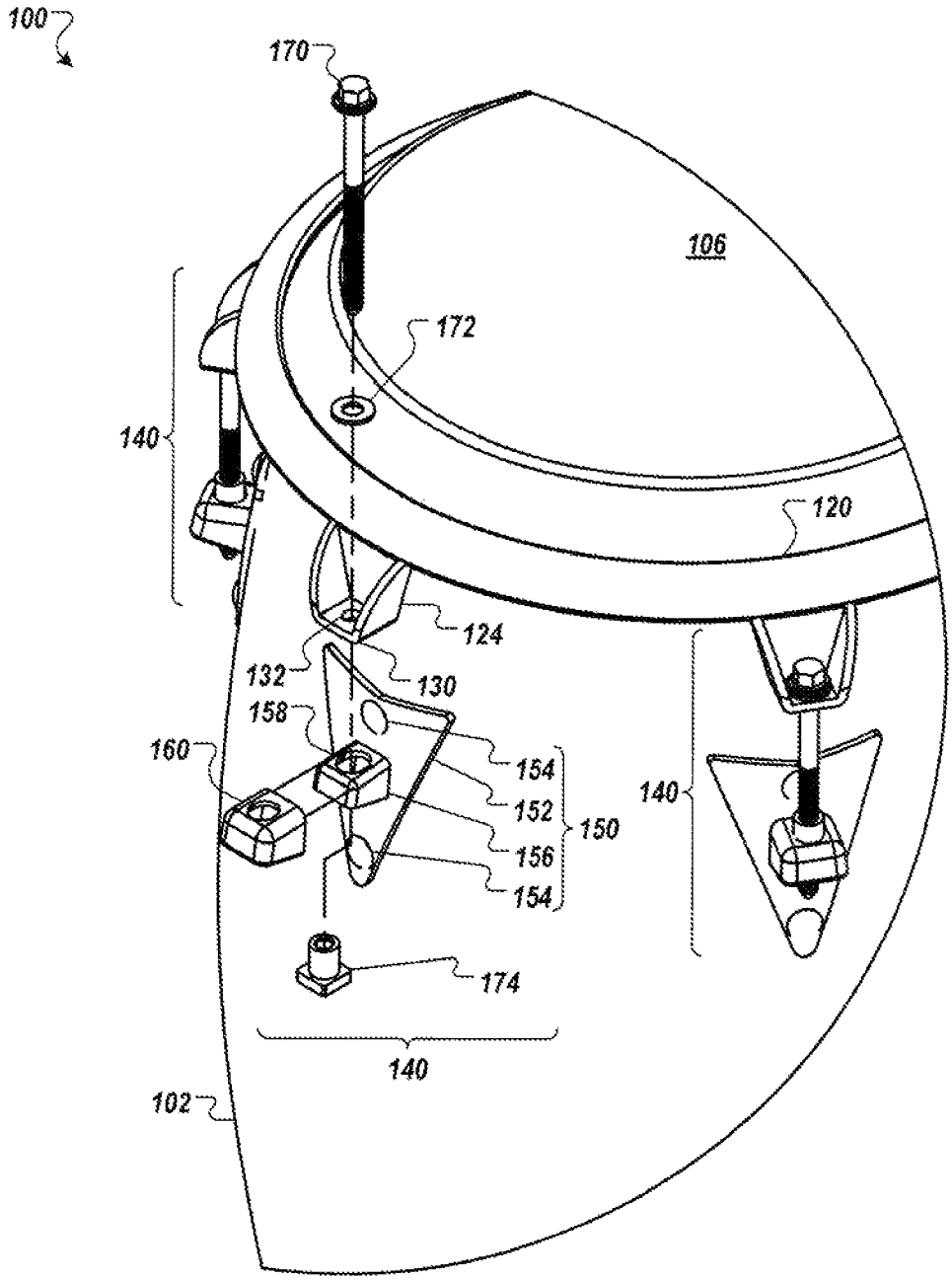
FIG. 4 is an exploded perspective view of an example top-tuning hand drum tuning assembly.

FIG. 4 is an enlarged view of the hand drum 100 wherein one of the tuning assemblies 140 is shown in an exploded view to better illustrate its components. Although all the tuning assemblies 140 have substantially identical construction, for the sake of clarity of the illustration only the components shown in the exploded view are numbered.

Each of the tuning assemblies 140 includes a side plate assembly 150. The side plate assembly 150 includes a base plate 152 affixed to the outer periphery of the shell 102 by bolts 154, adhesives, or other forms of fasteners. A receiving portion 156 extends outward, substantially normal to the base plate 152. The receiving portion 156 includes a hole 158 oriented substantially vertically with reference to the shell 102.

A bumper 160 made of a soft or compliant material (e.g., rubber, plastic, foam, wood) substantially covers the receiving portion 156. In some implementations, the bumper 160 may protect the receiving portion 156 from damage, may protect the percussionist from being injured if he were to bump into the receiving portion 156, and/or prevent the hand drum 100 from bumping into and damaging other objects.

The tuning assembly includes a threaded tuning rod 170 that is used to secure the rim 120 to the side plate assembly 150 and tune the hand drum 100. The threaded tuning rod is passed through a washer 172 and the hole 132. A nut 174 is passed through the hole 158 and is held in place by bumper 160. The threaded tuning rod 170 is threaded through the nut 174. In doing so, the head of the threaded tuning rod 170 and the washer 172 are drawn downward against the bottom section 130, while the nut 174 is drawn upward against the receiving portion 156.

As the threaded tuning rod 170 is tightened, a tensile force is created along the length of the bolt 170. In some embodiments, the nut 174 can move (float) within the receiving portion 156 such that the threaded tuning rod 170 may align itself vertically while secured to the receptacle assembly 124 and the receiving portion 156. For example, by allowing the nut 174 to move, the forces created within the threaded tuning rod 170 may be substantially tensile in nature with substantially no bending moments being imparted. In addition, the floating nut allows the side plate assembly to be mounted at the same height relative to the head of the drum regardless of the diameter of the shell of the drum.

In some embodiments, the heads of the threaded tuning rods 170 can be formed such that they are able to receive and be torqued by common hand-held tools (e.g., nut drivers, socket wrenches, hex keys, TORX wrenches, Robertson drivers, screwdrivers). For example, a percussionist may use a hardware store variety nut driver to engage the top end of the threaded tuning rod and adjust the tension between the rim 120 and the side plate assembly 150. In some implementations, by selectively torquing the threaded tuning rods 170, the rim 120 may adjustably stretch the skin 106 over the open playing end 104, thereby providing the percussionist with a way to tune the hand drum 100 from the top, rather than from the sides.

A number of embodiments of the invention have been described. Nevertheless, it will be understood that various modifications may be made without departing from the spirit and scope of the invention. For example, although the top-tuning system has been described with respect to a conga drum, a person of ordinary skill in the art would understand that this tuning-system may be used with other hand percussion instruments. Accordingly, other embodiments are within the scope of the following claims.

What is claimed is:

1. A tuning system for tuning a hand percussion instrument having a head and a shell, the tuning system comprising:

a rim, the rim secured to the head of the instrument, the rim comprising circular opening and a plurality of receptacles;

the receptacles integrally formed at an outer periphery of the rim and extending below the curcular opening, the receptacles having a side member, the side member being curved and projecting outward and downward below the circular opening, the receptacles having a horizontal member joined to the side member such that the horizontal member is held in a plane that is substantially parallel to the circular opening, the horizontal member comprising an opening;

a side plate assembly, the side plate assembly secured to the shell of the instrument;

a tuning rod, the tuning rod having a first end received by the opening such that the first end is held below the circular opening, the first end being accessible to a user for varying tension on the head; and the tuning rod having a second end received by the side plate assembly wherein the hand percussion instrument is one of a conga drum, djembe or bongo drum.

2. The tuning system of claim 1, wherein the side plate assembly comprises:

a base plate, the base plate having a receiving member that extends substantially perpendicular to the shell; and a nut, the nut receiving the second end of the tuning rod to secure the tuning rod to the receiving member.

3. The tuning system of claim 2, wherein the nut is movable within the receiving member so that the tuning rod may align vertically while secured to the receptacle and the receiving member.

4. The tuning system of claim 1, wherein the tuning rod is substantially straight.

5. The tuning system of claim 1, wherein the receptacles have a first side member and a second side member, the first and second side members being substantially parallel to each other.

6. A tuning system for tuning a hand percussion instrument having a head and a shell, the tuning system comprising:

a rim, the rim secured to the head of the instrument, the rim comprising circular opening and a plurality of receptacles;

the receptacles integrally formed at an outer periphery of the rim and extending below the circular opening, the receptacles having a vertical member, a horizontal member, and side member, the side member having a curved edge that projects outward and downward below the circular opening, the horizontal member joined to the side member such that the horizontal member is held in a plane that is substantially parallel to the circular opening, the horizontal member comprising an opening;

a side plate assembly, the side plate assembly secured to the shell of the instrument;

a tuning rod, the tuning rod having a first end received by the opening such that the first end is held below the circular opening, the first end being accessible to a user for varying tension on the head; and the tuning rod having a second end received by the side plate assembly wherein the hand percussion instrument is one of a conga drum, djembe or bongo drum.

7. The tuning system of claim 6, wherein the side plate assembly comprises:

a base plate, the base plate having a receiving member that extends substantially perpendicular to the shell; and a nut, the nut receiving the second end of the tuning rod to secure the tuning rod to the receiving member.

8. The tuning system of claim 7, wherein the nut is movable within the receiving member so that the tuning rod may align vertically while secured to the receptacle and the receiving member.

9. The tuning system of claim 6, wherein the tuning rod is substantially straight.

10. The tuning system of claim 6, wherein the receptacles have a first side member and a second side member, the first and second side members being substantially parallel to each other.

* * * * *